US008714766B2

(12) United States Patent
Schneider

(10) Patent No.: US 8,714,766 B2
(45) Date of Patent: May 6, 2014

(54) PLANAR ELEMENT, AND METHOD FOR THE PRODUCTION THEREOF

(76) Inventor: Thomas Schneider, Grunwald (DE)

( * ) Notice: Subject to any disclaimer, the term of this patent is extended or adjusted under 35 U.S.C. 154(b) by 705 days.

(21) Appl. No.: 12/601,873

(22) PCT Filed: May 27, 2008

(86) PCT No.: PCT/EP2008/004203

§ 371 (c)(1),
(2), (4) Date: Jun. 1, 2010

(87) PCT Pub. No.: WO2008/145341

PCT Pub. Date: Dec. 4, 2008

(65) Prior Publication Data

US 2010/0238656 A1 Sep. 23, 2010

(30) Foreign Application Priority Data

May 27, 2007 (DE) ..... 10 2007 025 014

(51) Int. Cl.
*F21V 33/00* (2006.01)

(52) U.S. Cl.
USPC ..... 362/127; 362/97.1; 362/145; 362/227; 362/812; 427/402; 428/411.1; 40/546; 40/572

(58) Field of Classification Search
USPC ..... 362/127, 145, 227, 97.1, 812; 427/402, 427/421.1, 428.01; 428/34.1, 195.1, 411.1, 428/426, 441, 457, 522, 532; 40/546, 572
See application file for complete search history.

(56) References Cited

U.S. PATENT DOCUMENTS

| | | | | |
|---|---|---|---|---|
| 4,179,760 | A | 12/1979 | Nakagawa | |
| 4,293,603 | A | 10/1981 | Hayman-Chaffey et al. | |
| 6,857,212 | B2 * | 2/2005 | Velez | 40/546 |

FOREIGN PATENT DOCUMENTS

| | | | |
|---|---|---|---|
| DE | 9417901 | U1 | 2/1995 |
| DE | 10110377 | C1 | 6/2002 |
| EP | 0864444 | A1 | 9/1998 |
| JP | 11-244238 | A | 9/1999 |
| JP | 2004-017636 | A | 1/2004 |
| JP | 2007-030307 | A | 2/2007 |

OTHER PUBLICATIONS

Thomas Lindner; "International Search Report"; PCT/EP2008/004203; Dec. 2, 2008.
International Preliminary Report on Patentability and Written Opinion of the International Searchin Authority issued Dec. 7, 2009; International Application No. PCT/EP2008/004203.

* cited by examiner

*Primary Examiner* — Stephen F Husar
*Assistant Examiner* — Meghan Dunwiddie
(74) *Attorney, Agent, or Firm* — Studebaker & Brackett PC

(57) ABSTRACT

A planar element as well as a method for producing such planar elements in such way that the planar element is easily and inexpensively to produce on the one hand and allows remarkable optical effects to be obtained on the other hand, it is proposed to apply at least one coating to at least one area or side of at least one support substrate, especially of at least one support plate.

23 Claims, 1 Drawing Sheet

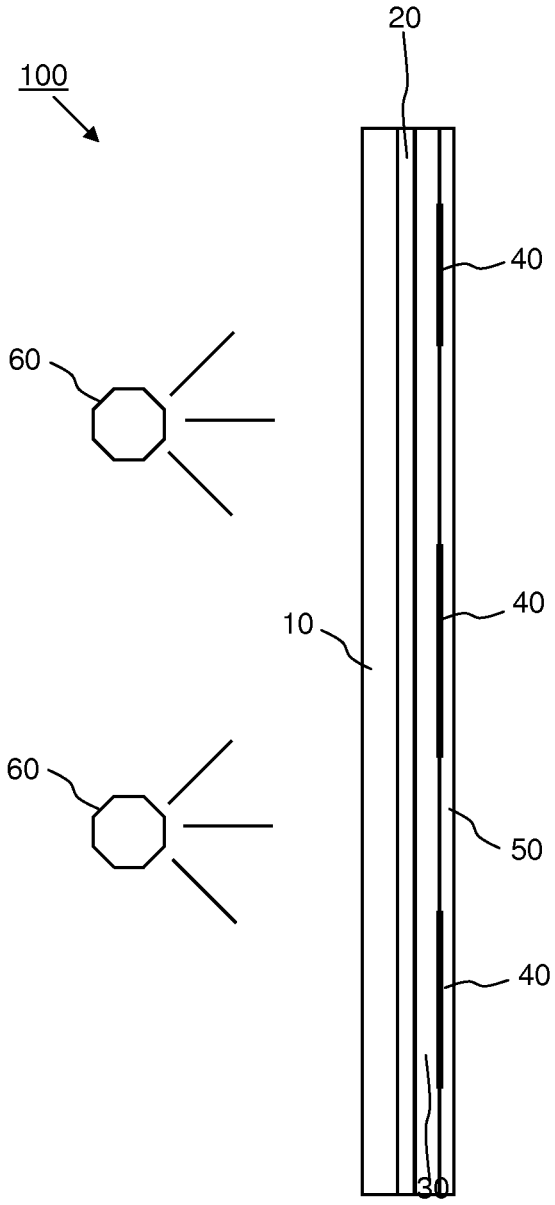
100
20
40
60
40
10
60
50
40
30

PLANAR ELEMENT, AND METHOD FOR THE PRODUCTION THEREOF

TECHNICAL FIELD

The present invention relates to a planar element and a method for producing such planar elements.

PRIOR ART

For the technical background to the present invention, reference is made to the publication DE 102 49 223 A1 from the prior art as well as to the publication EP 0 864 444 A2 from the prior art.

SUMMARY OF THE INVENTION

Proceeding from the disadvantages and deficiencies of the prior art references set forth above an advantage of the present invention is to develop a planar element of the below mentioned type as well as a method of the below mentioned type, such that the planar element, on the one hand, is able to be produced easily and inexpensively and, on the other hand, remarkable optical effects may be achieved by means of this planar element.

This advantage is achieved by a planar element having at least one support substrate, in particular at least one support plate, and at least one coating arranged on at least one area or side of the support substrate and producing at least one planar element, on at least one area or side of at least one support substrate, in particular at least one support plate with at least one coating being applied thereto. Advantageous embodiments and expedient developments of the present invention are also discussed hereinbelow.

In this connection, the support plates of the planar element may consist of different materials to ensure greater flexural strength as well as easier manufacturing; thus the support plate may advantageously be configured

- as acrylic sheet, as acrylic composite sheet or as Plexiglas sheet,
- as aluminum composite sheet, for example with a plastic core or with a mineral core and with two aluminum cover sheets,
- as a composite made of a polyethylene core material with a cover sheet, in particular stove-enameled on the front face, and with a cover sheet, in particular mill-finished on the rear face,
- as a building panel, in particular a lightweight, stable, water-impermeable, thermally-insulating building panel, acting in a vapor-retardant manner, or
- as plastics-coated fiberboard.

In this connection, the support material, i.e. the support plate is selected such that the plate corresponds to the nature of the application; acrylic, aluminum or polyethylene is a preferred support material for damp areas or wet areas, for example for shower cubicles, including a snail shower, or for swimming pools, the quality of the support material being able to be adapted to the application; for example the thermal stability may be selected to be between seventy degrees Celsius and 110 degrees Celsius.

Even the use of pure glass as a support material is possible; however, in this case, glass which is correspondingly resistant to bending and resistant to breaking (single thickness safety glass) should be selected and the relatively high weight should be considered.

Expediently, the size and the selected material of the panel predetermines the material thickness thereof. For example, with acrylic glass for a shower wall of a dimension of 1.2 meters to 2.0 meters, a thickness of approximately ten millimeters is necessary. If the substrate is absolutely smooth, the thickness may also be reduced. Also, when using building panels as a support substrate, a self-supporting construction may be produced, however a material thickness of at least approximately 25 millimeters is necessary.

The size of the walls to be coated is dependent on the production of the panel, in order to avoid the formation of gaps. When producing coated panels in situ, expediently acrylic sheet, aluminum composite sheet or polyethylene sheet joints may be bonded in order to avoid gaps in a reliable manner. In this connection, the suitability of the substrate as well as the thermal expansion has to be considered.

According to an expedient development of the present invention, the support plates are provided with a suitable primer which is appropriate for the choice of material, in order to ensure the adhesion of the applied material.

The coating of the panels may be carried out in different ways, preferably by

- a paint coating/painted finish, the paint coat being able to be applied in any design to fulfill design requirements; the application may, for example, be carried out by hand, by means of a spray device or by means of a plotter; the files are prepared for processing;
- films, which may be applied onto the support substrate which has, in particular, been primed; the design of the films may, for example, be implemented by a plotter.

According to an advantageous embodiment of the present invention a final sealing coat is applied, in particular repeatedly, for example three times, which may be selected depending on the chosen coating.

If the support substrate is provided, for example, with a paint coating and/or with a painted finish, the final coating of the panel takes place by a single or repeated application of a preferably transparent coating, which is scratch-resistant and wear-resistant. The coating may be rolled, painted or sprayed on. The appearance of the surface may be shiny, matt or may even be textured.

In the case of a film coating, a second film may be applied which has similar properties to the paint coating. This second film may be transparent or colored, and the surface is absolutely smooth. Also, the surface structure may be correspondingly influenced.

According to a preferred development of the present invention, the (acrylic or polyethylene) support plate may also be of translucent or transparent design.

Irrespective of, but preferably in combination with, such a translucent or transparent design of the support plate, the finished coated panel, for example in an embodiment as a cavity wall or as a cavity, may be back-lit. When using glass as support material, the coating is carried out from the rear face (also well-suited for back-lit variants).

Irrespective of, or in combination with, such back-lighting, the planar element may be provided with at least one printed image and/or with at least one inscription, for example in the form of advertising, namely for businesses, hotels or clubs. In this case, the printed image and/or the inscription may be applied separately or as part of the coating produced, for example, by means of a paint coating/painted finish or by means of film.

The optional embodiment of back-lighting the planar element, in particular in the use as a planar hollow element, may be combined in a particularly synergetic manner with the optional embodiment of the printed image and/or the lettering. As a result, particularly impressive visual effects may be achieved, as by means of the back-lighting the printed image and/or the lettering is visually highlighted and thus attracts specific attention.

With regard to the production of the planar element of the type set forth above, with a self-supporting assembly care has to be taken that the panels have a corresponding rigidity and are screwed, nailed or pegged in the manner of building panels.

If the panel, however, is bonded with special adhesive to a substrate, and joined on all sides, this bonding may be carried out in a point bonding method. The preparation of the substrate in this case is to follow the specification of the manufacturer of the adhesive.

The present invention finally relates to the use of at least one planar element according to the type set forth above and/or a method according to the type set forth above, as a decorative element, shower wall, the front of an item of furniture, partition or the like, in particular in damp areas or wet areas, for example for shower cubicles or for swimming pools.

As a result, the present invention provides many different possibilities for use and application, namely in the design of walls for high-quality baths and showers. The wall may thus be used directly as a shower wall. Additional sealing of the substrate is not necessary, depending on the selected material. The style may be created according to the requirements of the user.

A further intended use and application is in the form of a so-called renovation panel, i.e. the coated panel may also be directly applied during renovation or refurbishment, for example to old paintwork or tiling. The substrate must in this case be correspondingly load-bearing. By means of such renovation panels, for example, baths may be very rapidly redesigned.

As a result, by means of the present invention many different designs in terms of color design, film design and the like are possible, namely according to the requirements of businesses, hotels or clubs. The planar elements produced according to the invention are, in particular, shower-resistant, fade-resistant and acid-resistant.

BRIEF DESCRIPTION OF THE DRAWING

FIG. 1 is a schematic cross-sectional view of an embodiment for a planar element according to the present invention which is produced according to the method of the present invention.

DETAILED DESCRIPTION OF THE INVENTION

The planar element 100 according to FIG. 1 has a support substrate 10 in the form of a support plate, namely in the form of

- a translucent or transparent acrylic sheet, acrylic composite sheet or Plexiglas sheet,
- an aluminum composite sheet, for example with a plastic core or with a mineral core and with two aluminum cover sheets,
- a composite made of a polyethylene core material with a cover sheet, in particular stove-enameled on the front face, and with a cover sheet, in particular mill-finished on the rear face,
- a building panel, in particular a lightweight, stable, water-impermeable, thermally-insulating building panel, and/or a building panel acting in a vapor-retardant manner,
- plastic-coated fiberboard or
- a translucent or transparent glass sheet, in particular glass which is resistant to bending and resistant to breaking (single thickness safety glass) which is provided on one surface (namely in the cross-sectional view of FIG. 1 on the right-hand side) with a coating 30.

The coating 30, for example, which is rolled, painted or sprayed onto the support substrate 10, may be a paint coating and/or a painted finish; the coating 30 may, however, also be configured in the form of a film applied or bonded or laminated onto the support substrate 10.

In order to ensure the adhesion of the application of coating 30, between the support substrate 10 and the coating 30 a primer coat 20 is provided.

In particular, when using the planar element 100 as a decorative element, as a shower wall, as a partition or the like, for example in damp areas or wet areas, such as for example in shower cubicles or in swimming pools, a sealing coat 50 is of use, which protects the planar element 100 against any kind of effects, for example from liquids.

For example, underneath the sealing coat 50 the planar element 100 is provided with a printed image and/or with an inscription 40, for example in the form of advertising, namely for businesses, for hotels or for clubs. In this connection, the printed image and/or the inscription 40 may be applied separately between the coating 30 and the sealing coat 50 or as part of the coating 30 produced, for example, by means of a paint coating/painted finish or by means of film.

By means of a plurality of illuminating elements 60 arranged on the side remote from the coating 30, in the planar element 100 according to FIG. 1 a background illumination or backlighting is produced, by means of which in combination with the printed image and/or with the inscription 40 in a particularly synergetic manner particularly impressive visual effects are achieved, as by means of the back-lighting 60 the printed image and/or the lettering 40 may be visually highlighted and thus attract specific attention.

Also set forth is a method for producing the planar element 100. Therein, at least one coating 30 is applied on at least one area or side of the support substrate 10, and in particular at least one support plate. The method may be carried out by rolling on the coating 30, or painting or spraying the coating 30 onto the support substrate 10.

Prior to applying the coating to the support substrate 10, the support substrate 10 may be is primed with a primer 20. Subsequently, the planar element 100 is sealed with sealer 50, a process which may be repeated. Once formed, the planar element 100 may be illuminated or back lit by way of the illuminating element 60.

This application is based on International Application No. PCT/EP2008/004203, filed May 27, 2008 which is based on German Patent Application No. 10 2007 025 014.4 filed May 27, the contents of each being hereby incorporated herein by reference.

The invention claimed is:

1. A planar element comprising:

at least one support substrate configured of an acrylic sheet, an acrylic composite sheet, or a Plexiglas sheet, at least one coating arranged on at least one area or side of the support substrate, and at least one sealing coat arranged on the coating, wherein the support substrate is provided with at least one primer.

2. The planar element according to claim 1, wherein the support substrate is configured to be translucent or transparent.

3. The planar element according to claim 1, wherein the coating is configured as one of a paint coating and a painted finish or in the form of at least one film which may be applied to the support substrate.

4. The planar element according to claim 1, further comprising at least one printed image and inscription.

5. The planar element according to claim 1, further comprising at least one illuminating element, in particular backlighting, for example from the area or side of the planar element remote from the coating.

6. The planar element according to claim 1, wherein the planar element is one of a cavity or cavity wall.

7. Use of at least one planar element according to claim 1, as one of a decorative element, shower wall, the front of an item of furniture, partition or the like.

8. A method for producing at least one planar element, comprising:

providing at least one support substrate configured of an acrylic sheet, an acrylic composite sheet, or a Plexiglas sheet, coating at least one area or side of said at least one support substrate, and sealing the coating at least once, wherein the coating is rolled, painted or sprayed onto the support substrate.

9. The method according to claim 8, wherein the support substrate is primed.

10. The method according to claim 8, wherein the planar element is illuminated by backlighting the planar element.

11. A planar element comprising:

at least one support substrate configured of an acrylic sheet, an acrylic composite sheet, or a Plexiglas sheet, at least one coating arranged on at least one area or side of the support substrate, and at least one sealing coat arranged on the coating, wherein the coating is configured as one of a paint coating and a painted finish or in the form of at least one film which may be applied to the support substrate.

12. The planar element according to claim 11, wherein the support substrate is configured to be translucent or transparent.

13. The planar element according to claim 11, further comprising at least one printed image and inscription.

14. The planar element according to claim 11, further comprising at least one illuminating element, in particular backlighting, for example from the area or side of the planar element remote from the coating.

15. The planar element according to claim 11, wherein the planar element is one of a cavity or cavity wall.

16. Use of at least one planar element according to claim 11, as one of a decorative element, shower wall, the front of an item of furniture, partition or the like.

17. A planar element comprising:

at least one support substrate configured of an acrylic sheet, an acrylic composite sheet, or a Plexiglas sheet, at least one coating arranged on at least one area or side of the support substrate, and at least one sealing coat arranged on the coating, wherein the planar element is one of a cavity or cavity wall.

18. The planar element according to claim 17, wherein the support substrate is configured to be translucent or transparent.

19. The planar element according to claim 17, further comprising at least one printed image and inscription.

20. The planar element according to claim 17, further comprising at least one illuminating element, in particular backlighting, for example from the area or side of the planar element remote from the coating.

21. Use of at least one planar element according to claim 17, as one of a decorative element, shower wall, the front of an item of furniture, partition or the like.

22. A method for producing at least one planar element, comprising:

providing at least one support substrate configured of an acrylic sheet, an acrylic composite sheet, or a Plexiglas sheet, coating at least one area or side of said at least one support substrate, and sealing the coating at least once, wherein the support substrate is primed.

23. The method according to claim 22, wherein the planar element is illuminated by backlighting the planar element.

* * * * *